US006766289B2

(12) United States Patent
Kandhadai et al.

(10) Patent No.: US 6,766,289 B2
(45) Date of Patent: Jul. 20, 2004

(54) FAST CODE-VECTOR SEARCHING

(75) Inventors: Ananthapadmanabhan Kandhadai, San Diego, CA (US); Andrew P. DeJaco, San Diego, CA (US); Sharath Manjunath, Vijayanagar Bangalore (IN)

(73) Assignee: Qualcomm Incorporated, San Diego, CA (US)

( * ) Notice: Subject to any disclaimer, the term of this patent is extended or adjusted under 35 U.S.C. 154(b) by 150 days.

(21) Appl. No.: 09/874,657

(22) Filed: Jun. 4, 2001

(65) Prior Publication Data

US 2003/0028373 A1 Feb. 6, 2003

(51) Int. Cl.[7] ..... G10L 19/10
(52) U.S. Cl. ..... 704/207; 704/212; 704/216
(58) Field of Search ..... 704/207, 211, 704/212, 216, 217, 218, 221, 222, 223

(56) References Cited

U.S. PATENT DOCUMENTS

| | | | | |
|---|---|---|---|---|
| 5,265,190 A | | 11/1993 | Yip et al. | |
| 5,444,816 A | | 8/1995 | Adoul et al. | |
| 5,664,055 A | * | 9/1997 | Kroon | 704/223 |
| 5,732,389 A | * | 3/1998 | Kroon et al. | 704/223 |
| 5,751,901 A | * | 5/1998 | DeJaco et al. | 704/216 |
| 5,864,650 A | | 1/1999 | Taniguchi et al. | |
| 6,141,638 A | * | 10/2000 | Peng et al. | 704/211 |
| 6,169,970 B1 | * | 1/2001 | Kleijn | 704/219 |

FOREIGN PATENT DOCUMENTS

EP 0619574 10/1994

OTHER PUBLICATIONS

Taniguchi et al., "Pitch sharpening for perceptually improved CELP, and the sparse–delta codebook for reduced computation," 1991 International Conference on Acoustics, Speech, and Signal Processing, Apr. 14–17, 1991, vol. 1, pp. 241–244.*

J–P. Adoul, et al. "Fast CELP coding based on algebraic codes," Communication Research Center, University of Sherbrooke, Sherbrooke, P.Q., Canada, J1K2R1. IEEE 1987 (pp. 1957–1960).

* cited by examiner

*Primary Examiner*—Richemond Dorvil
*Assistant Examiner*—Martin Lerner
(74) *Attorney, Agent, or Firm*—Philip Wadsworth; Charles D. Brown; Kyong H. Macek

(57) ABSTRACT

Methods and apparatus for quickly selecting an optimal excitation waveform from a codebook are presented herein. In encoding schemes that use forward and backward pitch enhancement, storage and processor load is reduced by approximating a two-dimensional autocorrelation matrix with a one-dimensional autocorrelation vector. The approximation is possible when a cross-correlation element is configured to determine the autocorrelation matrix of an impulse response and a pulse energy determination element is configured to determine the energy of a pulse code vector that incorporates secondary pulse positions.

8 Claims, 3 Drawing Sheets

FAST CODE-VECTOR SEARCHING

BACKGROUND

1. Field

The present invention relates generally to communication systems, and more particularly, to speech processing within communication systems.

2. Background

The field of wireless communications has many applications including, e.g., cordless telephones, paging, wireless local loops, personal digital assistants (PDAs), Internet telephony, and satellite communication systems. A particularly important application is cellular telephone systems for mobile subscribers. As used herein, the term "cellular" system encompasses both cellular and personal communications services (PCS) frequencies. Various over-the-air interfaces have been developed for such cellular telephone systems including, e.g., frequency division multiple access (FDMA), time division multiple access (TDMA), and code division multiple access (CDMA). In connection therewith, various domestic and international standards have been established including, e.g., Advanced Mobile Phone Service (AMPS), Global System for Mobile (GSM), and Interim Standard 95 (IS-95). In particular, IS-95 and its derivatives, IS-95A, IS-95B, ANSI J-STD-008 (often referred to collectively herein as IS-95), and proposed high-data-rate systems for data, etc. are promulgated by the Telecommunication Industry Association (TIA) and other well known standards bodies.

Cellular telephone systems configured in accordance with the use of the IS-95 standard employ CDMA signal processing techniques to provide highly efficient and robust cellular telephone service. Exemplary cellular telephone systems configured substantially in accordance with the use of the IS-95 standard are described in U.S. Pat. Nos. 5,103,459 and 4,901,307, which are assigned to the assignee of the present invention and incorporated by reference herein. An exemplary system utilizing CDMA techniques is the cdma2000 ITU-R Radio Transmission Technology (RTT) Candidate Submission (referred to herein as cdma2000), issued by the TIA. The standard for cdma2000 is given in the draft versions of IS-2000 and has been approved by the TIA. The cdma2000 proposal is compatible with IS-95 systems in many ways. Another CDMA standard is the W-CDMA standard, as embodied in 3rd *Generation Partnership Project* "3GPP", Document Nos. 3G TS 25.211, 3G TS 25.212, 3G TS 25.213, and 3G TS 25.214.

With the proliferation of digital communication systems, the demand for efficient frequency usage is constant. One method for increasing the efficiency of a system is to transmit compressed signals. In a regular landline telephone system, a sampling rate of 64 kilobits per second (kbps) is used to recreate the quality of an analog voice signal in a digital transmission. However, by using compression techniques that exploit the redundancies of a voice signal, the amount of information that is transmitted over-the-air can be reduced while still maintaining a high quality.

Typically, conversion of an analog voice signal to a digital signal is performed by an encoder and conversion of the digital signal back to a voice signal is performed by a decoder. In an exemplary CDMA system, a vocoder comprising both an encoding portion and a decoding portion is located within remote stations and base stations. An exemplary vocoder is described in U.S. Pat. No. 5,414,796, entitled "Variable Rate Vocoder," assigned to the assignee of the present invention and incorporated by reference herein. In a vocoder, an encoding portion extracts parameters that relate to a model of human speech generation. A decoding portion re-synthesizes the speech using the parameters received over a transmission channel. The model is constantly changing to accurately model the time varying speech signal. Thus, the speech is divided into blocks of time, or analysis frames, during which the parameters are calculated. The parameters are then updated for each new frame. As used herein, the word "decoder" refers to any device or any portion of a device that can be used to convert digital signals that have been received over a transmission medium. The word "encoder" refers to any device or any portion of a device that can be used to convert acoustic signals into digital signals. Hence, the embodiments described herein can be implemented with vocoders of CDMA systems, or alternatively, encoders and decoders of non-CDMA systems.

Of the various classes of speech coder, the Code Excited Linear Predictive Coding (CELP), Stochastic Coding, or Vector Excited Speech Coding coders are of one class. An example of a coding algorithm of this particular class is described in Interim Standard 127 (IS-127), entitled, "Enhanced Variable Rate Coder" (EVRC). Another example of a coder of this particular class is described in pending draft proposal "Selectable Mode Vocoder Service Option for Wideband Spread Spectrum Communication Systems," Document No. 3GPP2 C.P9001. The function of the vocoder is to compress the digitized speech signal into a low bit rate signal by removing all of the natural redundancies inherent in speech. In a CELP coder, redundancies are removed by means of a short-term formant (or LPC) filter. Once these redundancies are removed, the resulting residual signal can be modeled as white Gaussian noise, or a white periodic signal, which also must be coded. Hence, through the use of speech analysis, followed by the appropriate coding, transmission, and re-synthesis at the receiver, a significant reduction in the data rate can be achieved.

The coding parameters for a given frame of speech are determined by first determining the coefficients of a linear prediction coding (LPC) filter. The appropriate choice of coefficients will remove the short-term redundancies of the speech signal in the frame. Long-term periodic redundancies in the speech signal are removed by determining the pitch lag, L, and pitch gain, $g_p$, of the signal. The combination of possible pitch lag values and pitch gain values is stored as vectors in an adaptive codebook. An excitation signal is then chosen from among a number of waveforms stored in an excitation waveform codebook. When the appropriate excitation signal is excited by a given pitch lag and pitch gain and is then input into the LPC filter, a close approximation to the original speech signal can be produced. Thus, a compressed speech transmission can be performed by transmitting LPC filter coefficients, an identification of the adaptive codebook vector, and an identification of the fixed codebook excitation vector.

An effective excitation codebook structure is referred to as an algebraic codebook. The actual structure of algebraic codebooks is well known in the art and is described in the paper "Fast CELP coding based on Algebraic Codes" by J. P. Adoul, et al., Proceedings of ICASSP Apr. 6–9, 1987. The use of algebraic codes is further disclosed in U.S. Pat. No. 5,444,816, entitled "Dynamic Codebook for Efficient Speech Coding Based on Algebraic Codes", the disclosure of which is incorporated by references.

Due to the intensive computational and storage requirements of implementing codebook searches for optimal excitation vectors, there is a constant need to increase the speed of codebook searches.

SUMMARY

Novel methods and apparatus for implementing a fast code vector search in coders are presented. In one aspect, a method is presented for selecting a code vector in an algebraic codebook wherein a pre-computed Toeplitz autocorrelation matrix, stored as single dimensional vector of the weighting filter impulse response, and pitch-sharpened pulses are used for a fast codebook search that greatly saves the storage memory required for conducting the codebook search.

In another aspect, an apparatus is presented for selecting an optimal pulse vector from a pulse vector codebook, wherein the optimal pulse vector is used by a linear prediction coder to encode a residual waveform. The apparatus comprises: an impulse response generator for outputting an impulse response vector; a correlation element configured to receive the impulse response vector and a plurality of target signal samples, to output an autocorrelation value based on the impulse response vector, and to output a cross-correlation vector based on a composite impulse response vector and the plurality of target signal samples, wherein the composite impulse response vector is determined using the impulse response vector; and a pulse energy determination element configured to generate an energy value using a pulse vector from the pulse vector codebook, a composite pulse vector that is determined using the pulse vector, and the autocorrelation value, wherein the energy value and the autocorrelation value are used by a metric calculator to determine a ratio value that is used to select the optimal pulse vector.

In another aspect, a method for selecting an optimal pulse vector from a codebook of pulse vectors is presented. The method comprises: determining an autocorrelation value associated with an impulse response vector; determining a cross-correlation value associated with a target signal and a pitch-sharpened impulse response vector, wherein the pitch-sharpened impulse response vector is determined from the impulse response vector; determining an energy value for each pulse vector from a plurality of pulse vectors, wherein the energy value is determined using each pulse vector and a pitch-sharpened pulse vector associated with each pulse vector; and using the plurality of energy values and the cross-correlation value to determine a plurality of ratios, wherein the residual waveform is encoded by using the pulse vector that is selected as having the highest ratio of the plurality of ratios.

DETAILED DESCRIPTION

Figure 1:
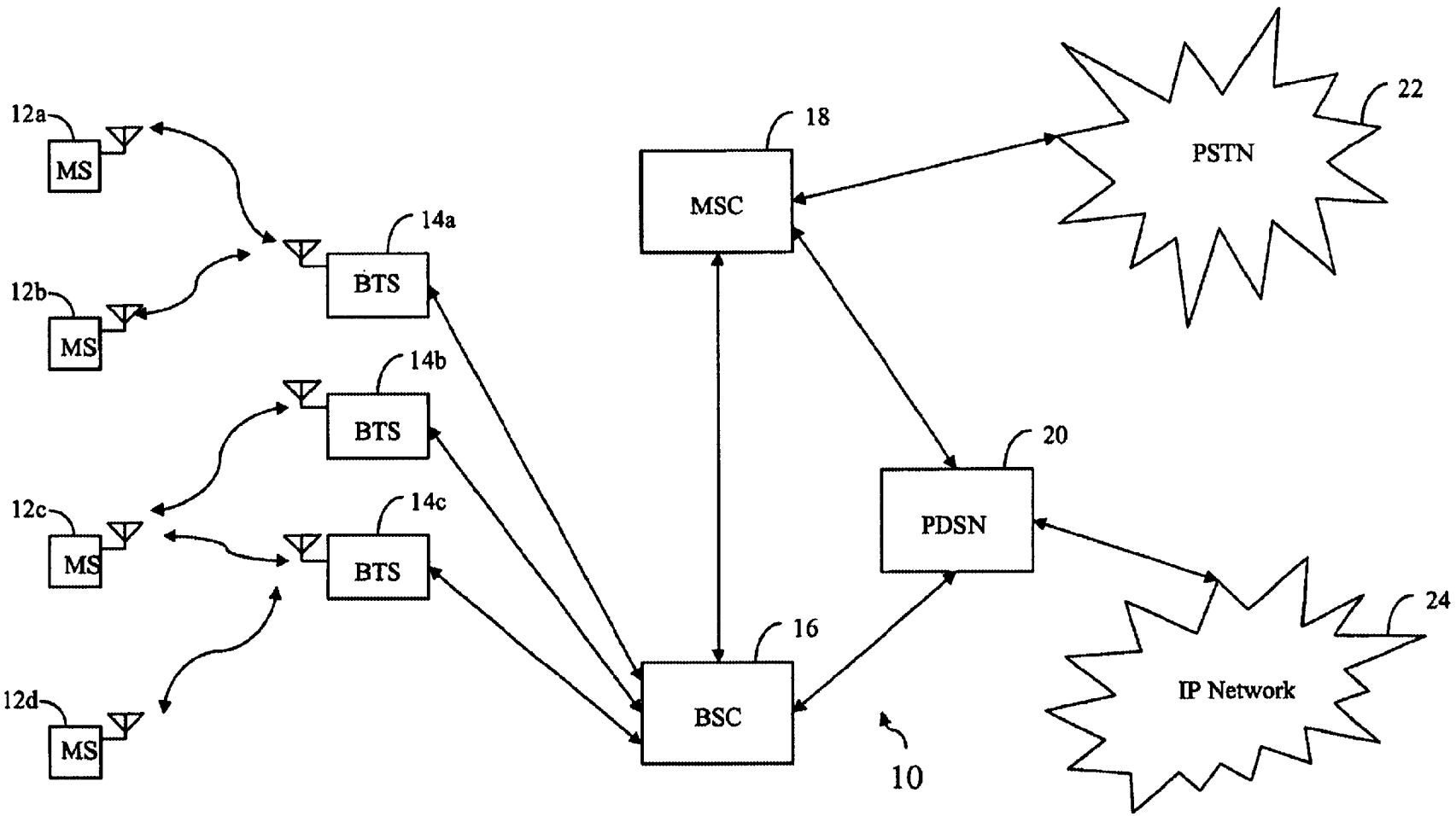
FIG. 1 is a block diagram of an exemplary communication system.

As illustrated in FIG. 1, a wireless communication network 10 generally includes a plurality of remote stations (also called mobile stations or subscriber units or user equipment) 12*a*–12*d*, a plurality of base stations (also called base station transceivers (BTSs) or Node B) 14*a*–14*c*, a base station controller (BSC) (also called radio network controller or packet control function 16), a mobile switching center (MSC) or switch 18, a packet data serving node (PDSN) or internetworking function (IWF) 20, a public switched telephone network (PSTN) 22 (typically a telephone company), and an Internet Protocol (IP) network 24 (typically the Internet). For purposes of simplicity, four remote stations 12*a*–12*d*, three base stations 14*a*–14*c*, one BSC 16, one MSC 18, and one PDSN 20 are shown. It would be understood by those skilled in the art that there could be any number of remote stations 12, base stations 14, BSCs 16, MSCs 18, and PDSNs 20.

In one embodiment the wireless communication network 10 is a packet data services network. The remote stations 12*a*–12*d* may be any of a number of different types of wireless communication device such as a portable phone, a cellular telephone that is connected to a laptop computer running IP-based, Web-browser applications, a cellular telephone with associated hands-free car kits, a personal data assistant (PDA) running IP-based, Web-browser applications, a wireless communication module incorporated into a portable computer, or a fixed location communication module such as might be found in a wireless local loop or meter reading system. In the most general embodiment, remote stations may be any type of communication unit.

The remote stations 12*a*–12*d* may be configured to perform one or more wireless packet data protocols such as described in, for example, the EIA/TIA/IS-707 standard. In a particular embodiment, the remote stations 12*a*–12*d* generate IP packets destined for the IP network 24 and encapsulate the IP packets into frames using a point-to-point protocol (PPP).

In one embodiment, the IP network 24 is coupled to the PDSN 20, the PDSN 20 is coupled to the MSC 18, the MSC 18 is coupled to the BSC 16 and the PSTN 22, and the BSC 16 is coupled to the base stations 14*a*–14*c* via wirelines configured for transmission of voice and/or data packets in accordance with any of several known protocols including, e.g., E1, T1, Asynchronous Transfer Mode (ATM), IP, Frame Relay, HDSL, ADSL, or xDSL. In an alternate embodiment, the BSC 16 is coupled directly to the PDSN 20, and the MSC 18 is not coupled to the PDSN 20. In another embodiment, the remote stations 12*a*–12*d* communicate with the base stations 14*a*–14*c* over an RF interface defined in the 3rd *Generation Partnership Project* 2 "3*GPP*2", "Physical Layer Standard for cdma2000 Spread Spectrum Systems," 3GPP2 Document No. C.P0002-A, TIA PN-4694, to be published as TIA/EIA/IS-2000-2-A, (Draft, edit version 30) (Nov. 19, 1999), which is fully incorporated herein by reference. In another embodiment, the remote stations 12*a*–12*d* communicate with the base stations 14*a*–14*c* over an RF interface defined in 3rd *Generation Partnership Project*"3*GPP*", Document Nos. 3G TS 25.211, 3G TS 25.212, 3G TS 25.213, and 3G TS 25.214.

During typical operation of the wireless communication network 10, the base stations 14*a*–14*c* receive and demodulate sets of reverse-link signals from various remote stations 12*a*–12*d* engaged in telephone calls, Web browsing, or other data communications. Each reverse-link signal received by a given base station 14*a*–14*c* is processed within that base station 14*a*–14*c*. Each base station 14*a*–14*c* may communicate with a plurality of remote stations 12*a*–12*d* by modulating and transmitting sets of forward-link signals to the remote stations 12a–12d. For example, as shown in FIG. 1, the base station 14a communicates with first and second remote stations 12a, 12b simultaneously, and the base station 14c communicates with third and fourth remote stations 12c, 12d simultaneously. The resulting packets are forwarded to the BSC 16, which provides call resource allocation and mobility management functionality including the orchestration of soft handoffs of a call for a particular remote station 12a–12d from one base station 14a–14c to another base station 14a–14c. For example, a remote station 12c is communicating with two base stations 14b, 14c simultaneously. Eventually, when the remote station 12c moves far enough away from one of the base stations 14c, the call will be handed off to the other base station 14b.

If the transmission is a conventional telephone call, the BSC 16 will route the received data to the MSC 18, which provides additional routing services for interface with the PSTN 22. If the transmission is a packet-based transmission, such as a data call destined for the IP network 24, the MSC 18 will route the data packets to the PDSN 20, which will send the packets to the IP network 24. Alternatively, the BSC 16 will route the packets directly to the PDSN 20, which sends the packets to the IP network 24.

As discussed above, a speech signal can be segmented into frames, and then modeled by the use of LPC filter coefficients, adaptive codebook vectors, and fixed codebook vectors. In order to create an optimal model of the speech signal, the difference between the actual speech and the recreated speech must be minimal. One technique for determining whether the difference is minimal is to determine the correlation values between the actual speech and the recreated speech and to then choose a set of components with a maximum correlation property.

Figure 2:
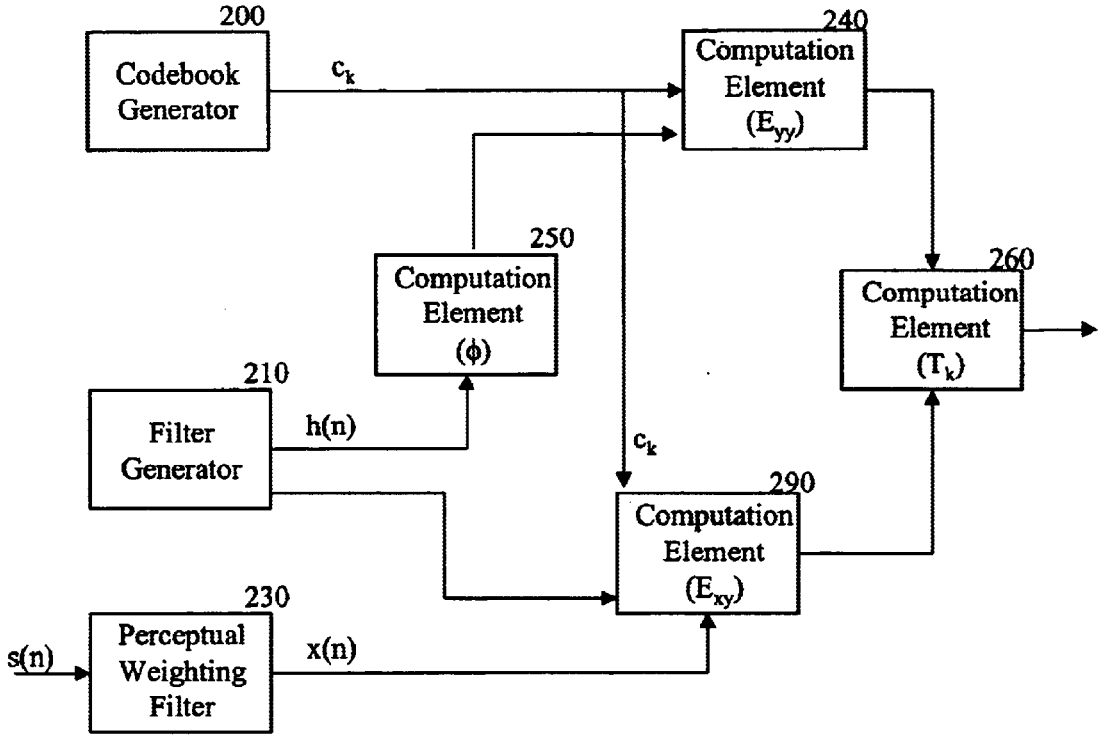
FIG. 2 Prior Art
FIG. 2 is a block diagram of a conventional apparatus for performing codebook searches.

FIG. 2 is a block diagram of an apparatus in a conventional encoder for selecting an optimal excitation vector from a codebook. This encoder is designed to minimize the computational complexity involved when convolving an input signal with the impulse response of a filter, said complexity being further increased by the need to convolve multiple input signals in order to determine which input signal results in the closest match to a target signal. To reduce the complexity, this encoder convolves a group of input signals with an impulse response that has been extended with zero-values. This extension results in an impulse response that is stationary. The autocorrelation matrix for a stationary impulse response has a Toeplitz form.

A frame of speech samples s(n) is filtered by a perceptual weighting filter 230 to produce a target signal x(n). The design and implementation of perceptual weighting filters is described in aforementioned U.S. Pat. No. 5,414,796. An impulse response generator 210 generates an impulse response h(n). Using the impulse response h(n) and the target signal x(n), a cross-correlation vector d(i) is generated at computation element 290 in accordance with the following relationship:

$$d(i) = \sum_{j=1}^{M} x(i)h(i-j), \text{ for } j = 1 \text{ to } M.$$

The impulse response h(n) is also used by computation element 250 to generate an autocorrelation matrix:

$$\phi(i, j) = \sum_{n=j}^{M} h(n-i)h(n-j), \text{ for } i \geq j$$

The autocorrelation matrix $\phi$ becomes a Toeplitz matrix if the analysis window is extended from M samples to M+L−1 samples, wherein the extra samples are zero-valued. A Toeplitz matrix is a square matrix whose entries are constant along each diagonal. Hence, the Toeplitz autocorrelation matrix can be represented by a one-dimensional vector, rather than a two-dimensional matrix.

The entries of the autocorrelation matrix $\phi$ are sent to computation element 240. Pulse codebook generator 200 generates a plurality of pulse vectors $\{c_k, k=1, \ldots, M\}$, which are also input into computation element 240. An excitation waveform codebook, alternatively referred to as a pulse waveform codebook or a pulse codebook herein, can be generated in response to a plurality of pulse position signals, $\{p_i, i=1, \ldots, M\}$ (not shown in figure), wherein i is the position of a unit pulse in the pulse vector. $N_p$ is a value representing the number of pulses in a pulse vector. Computation element 240 filters the pulse vectors with the autocorrelation matrix $\phi$ in accordance with the following formula:

$$E_{yy} = \sum_{i=0}^{N_p-1} \phi(p_i, p_j) + 2 \cdot \sum_{i=0}^{N_p-1} \sum_{j=i+1}^{N_p-1} c_k(p_i)c_k(p_j)\phi(p_i, p_j).$$

The pulse vectors $\{c_k, k=1, \ldots, M\}$ are also used by computation element 290 to determine a cross-correlation between d(n) and $c_k(n)$ according to the following equation:

$$E_{xy}^2 = \left(\sum_{i=0}^{N_p-1} c_k(p_i) \cdot d(p_i)\right)^2.$$

Once values for $E_{yy}$ and $E_{xy}$ are known, a computation element 260 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform.

The search for the optimum pulse vector using the above scheme is efficient due to the simplification of the autocorrelation matrix $\phi$. However, the apparatus of FIG. 2 cannot be implemented in the new generation of voice encoders, such as the Enhanced Variable Rate Codec (EVRC) and the Selectable Mode Vocoder (SMV). In the apparatus of FIG. 2, the simplification of the autocorrelation matrix $\phi$ is possible by extending the window of the speech frame with zero values so that impulse response h(n) becomes stationary. Accordingly, the entries of autocorrelation matrix $\phi$ are such that $\phi(i, j)=\phi(i-j)$.

However, in some of the new vocoders, such as the ones mentioned above, the windows of the speech frame cannot be extended with zero values due to the incorporation of non-zero valued contributions from pitch periodicity. In these vocoders, the pitch periodicity contribution of the codebook pulses is enhanced by incorporating a gain-adjusted forward and backward pitch sharpening process into the analysis frame of the speech signal.

An example of pitch sharpening is the formation of a composite impulse response $\tilde{h}(n)$ from h(n) in accordance with the following relationship:

$$\tilde{h}(n) = g_p^{P-1}h(n-(P-1)L) + \ldots + g_p^3 h(n-3L) + g_p^2 h(n-2L) + g_p h(n-L) + h(n) + g_p h(n+L) + g_p^2 h(n+2L) + g_p^3 h(n+3L) + \ldots + g_p^{P-1} h(n+(P-1)L)$$

in which P is the number of pitch lag periods (whole or partial) of length L contained in the subframe, L is the pitch lag, and $g_p$ is the pitch gain.

Figure 3:
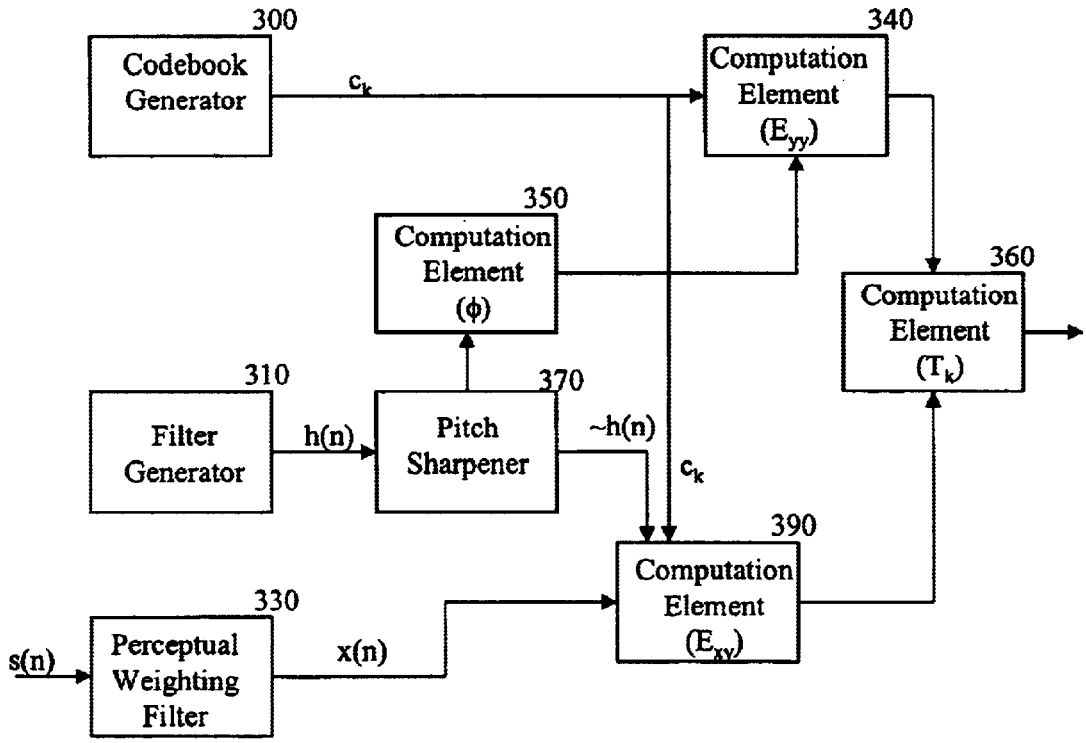
FIG. 3 is a block diagram of an apparatus for performing slow codebook searches in a coder that uses pitch enhanced impulse responses.

FIG. 3 is a block diagram of an apparatus for searching an excitation codebook in which the impulse response of the filter has been pitch enhanced. A frame of speech samples s(n) is filtered by a perceptual weighting filter 330 to produce a target signal x(n). An impulse response generator 310 generates an impulse response h(n). The impulse response h(n) is input into a pitch sharpener element 370 and yields a composite impulse response $\tilde{h}(n)$. The composite impulse response $\tilde{h}(n)$ and the target signal x(n) are input into a computation element 390 to determine a cross-correlation vector d(i) in accordance with the following relationship:

$$d(i) = \sum_{j=1}^{M} x(i)\tilde{h}(i-j), \text{ for } j = 1 \text{ to } M.$$

The composite impulse response $\tilde{h}(n)$ is also used by computation element 350 to generate an autocorrelation matrix:

$$\phi(i, j) = \sum_{n=j}^{M} \tilde{h}(n-i)\tilde{h}(n-j), \text{ for } i \geq j.$$

The entries of the autocorrelation matrix $\phi$ are sent to computation element 340. Pulse codebook generator 300 generates a plurality of pulse vectors $\{c_k, k=1, \ldots, M\}$, which are also input into computation element 340. Computation element 340 filters the pulse vectors with the autocorrelation matrix in accordance with the formula:

$$E_{yy} = \sum_{i=0}^{N_p-1} \phi(p_i, p_j) + 2 \cdot \sum_{i=0}^{N_p-1} \sum_{j=i+1}^{N_p-1} c_k(p_i)c_k(p_j)\phi(p_i, p_j).$$

The pulse vectors $\{c_k, k=1, \ldots, M\}$ are also used by computation element 390 to determine a cross-correlation between d(n) and $c_k(n)$ according to the following equation:

$$E_{xy}^2 = \left(\sum_{i=0}^{N_p-1} c_k(p_i) \cdot d(p_i)\right)^2.$$

Once values for $E_{yy}$ and $E_{xy}$ are known, a computation element 360 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform. Since the composite impulse response $\tilde{h}(n)$ is no longer stationary, the autocorrelation matrix cannot be simplified to a single-dimensional matrix, and the total number of elements required to store the $\phi$ matrix remain large.

The embodiments described below address the need for more efficient computational schemes within the new generation of coders, which are designed to enhance the contribution of pitch periodicity. The embodiments describe a methodology that may be considered counterintuitive to one skilled in the art, but appropriate choices in certain pitch period values can result in a beneficial result. In particular, a widely held belief in the art is that the number of pulses in the pulse code vector should remain small in order to minimize the number of bits needed to represent the vector. A pulse code vector is a vector with unit pulses in designated spaces, wherein the remaining spaces are designated as zero-valued. An example of a pulse vector with a small number of pulses is one with less than 14% of the available spaces occupied by a unit pulse.

The embodiments described herein deliberately increase the number of pulses within a code vector. In the coders that enhance the pitch of the impulse response, forward and backward lag values are folded into the window frame that is currently under analysis to form a composite impulse response. In these coders, the autocorrelation matrix $\phi$ is determined based on the composite impulse response.

The embodiments described herein avoid using the composite impulse response to determine the autocorrelation matrix $\phi$. Rather than using a composite impulse response, the embodiments determine composite pulse codebook vectors, wherein the forward and backward lag values of a pulse code vector are folded back into the code vector. This incorporation of lag values increases the number of pulses in the code vector, which in turn, violates the commonly held belief that the number of code vector pulses should remain minimal. If a composite pulse code vector is used, the need to determine an autocorrelation matrix $\phi$ based on the composite impulse response no longer exists due to the following relationship:

$$c \otimes \tilde{h} = \tilde{c} \otimes h.$$

The above equation states that the result of convolving a pulse code vector with a pitch-sharpened impulse response is equivalent to the result of convolving the pitch-sharpened pulse code vector with the impulse response.

If the impulse response rather than the composite impulse response is used to determine the autocorrelation matrix $\phi$, then the embodiments herein implicitly assume that the impulse response could be extended with zero values. This assumption is contrary to the practice of folding non-zero lag values back into the impulse response as stated above. Using this assumption, the embodiments approximate the two-dimensional autocorrelation matrix $\phi$ with a one-dimensional autocorrelation matrix in order to perform a fast search for an optimal excitation or pulse waveform in coders that use pitch-sharpened impulse responses.

Figure 4:
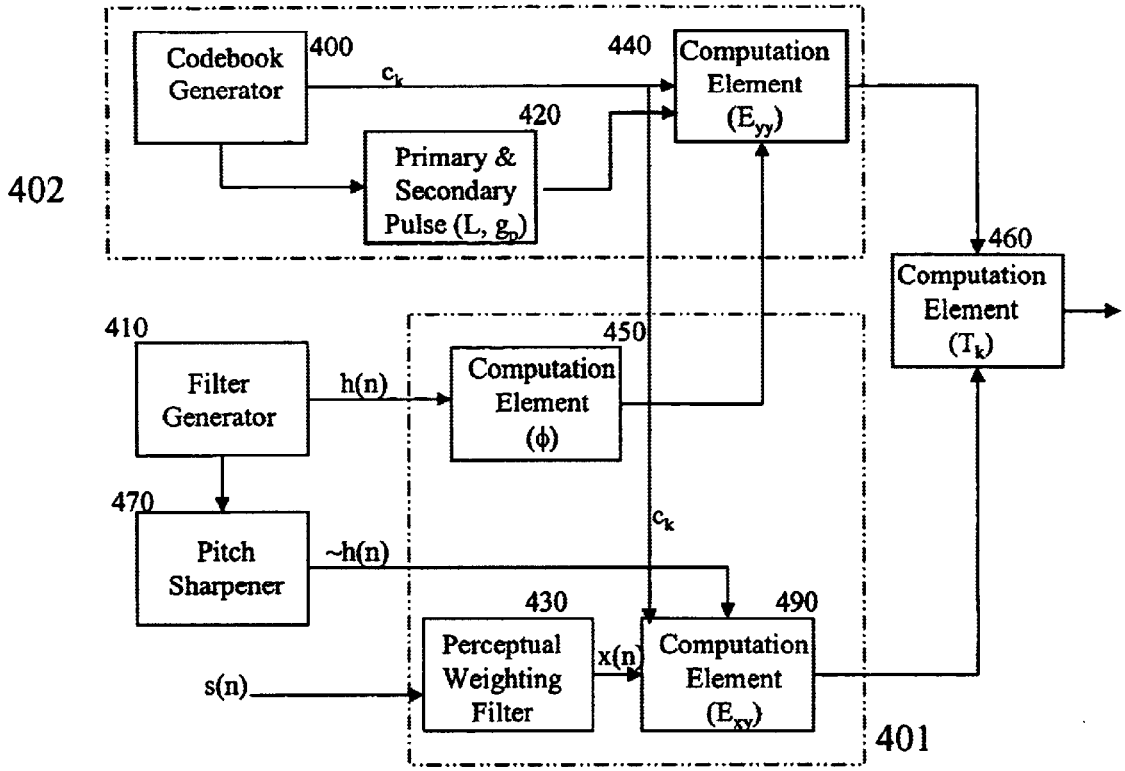
FIG. 4 is a block diagram of an apparatus for performing fast codebook searches in a coder that uses pitch enhanced impulse responses.

FIG. 4 is a block diagram of an apparatus that will perform a fast codebook search using composite pulse vectors. In one embodiment, the pulse vectors in the codebook are 80 samples long and the unit pulse can be located at any of the 80 sample positions. The number of unit pulses in each code vector should remain small, e.g., either 1 or 2 if there are 80 sample positions. Vectors with more pulses could be used in larger sized analysis windows. For each pulse, $p_i$, a corresponding sign $s_i$ is assigned to the pulse. The resulting code vector, $c_k$, is given by the equation below $$c_k(j) = \sum_{i=0}^{N_p-1} s_i\delta(j - p_i).$$

A frame of speech samples s(n) is filtered by a perceptual weighting filter 430 to produce a target signal x(n). An impulse response generator 410 generates an impulse response h(n). The impulse response h(n) is input into a pitch sharpener element 470 and yields a composite impulse response $\tilde{h}(n)$. The composite impulse response $\tilde{h}(n)$ and the target signal x(n) are input into a computation element 490 to determine a cross-correlation vector d(i) in accordance with the following relationship:

$$d(i) = \sum_{j=1}^{M} x(i)\tilde{h}(i - j), \text{ for } j = 1 \text{ to } M.$$

The impulse response h(n) is also used by computation element 450 to generate a single dimensional autocorrelation matrix:

$$\phi(i) = \sum_{n=0}^{M-1} h(n)h(n - i).$$

The entries of the autocorrelation matrix $\phi$ are sent to computation element 440. Pulse codebook generator 400 generates a plurality of pulse vectors $\{c_k, k=1, \ldots, M\}$, which are altered by pitch sharpening element 420 to form composite pulse vectors in accordance with the following formula:

$$p_i^k = p_i^0 + kL,\ k = -k_1, -k_1+1, \ldots, 0, 1, 2, \ldots, k_2,$$

where $k_1$, and $k_2$ are chosen to be maximum in the range $0 \leqq k_1, k_2 < M$ such that $0 \leqq p_i^k < M$. Each primary pulse $p_i^0$ will have 0 or more secondary pulses depending on the primary pulse position in the vector, and the pitch lag. For example, for lag L=33, vector size M=80, and the primary position of the $i^{th}$ pulse being $p_i^0=46$, the secondary pulse positions are $p_i^{-1}=13$, and $p_i^1=79$. Hence, the composite pulse vector comprises primary pulses and secondary pulses.

The composite pulse vectors, the pulse vectors, and the autocorrelation matrix $\phi$ are input into computation element 440. Computation element 440 filters the pulse vectors and the composite pulse vectors in accordance with the following formula:

$$E_{yy} = \sum_{i=0}^{N_p-1} \sum_{v=-k_1}^{k_2} g_p^{|v|}\phi(0) + 2\cdot \sum_{i=0}^{N_p-1} \sum_{w=-k_1}^{k_2} \sum_{j=i+1}^{N_p-1} \sum_{v=-k_1}^{k_2} g_p^{|w|} g_p^{|v|} c_k(p_i^0) c_k(p_j^0) \phi(|p_i^w - p_j^v|).$$

The pulse vectors $\{c_k, k=1, \ldots, M\}$ are also used by computation element 490 to determine a cross-correlation between d(n) and $c_k(n)$ according to the following equation:

$$E_{xy}^2 = \left(\sum_{i=0}^{N_p-1} c_k(p_i)\cdot d(p_i)\right)^2.$$

Once values for $E_{yy}$ and $E_{xy}$ are known, a computation element 460 determines the value $T_k$ using the following relationship:

$$T_k = \frac{(E_{xy})^2}{E_{yy}}.$$

The pulse vector that corresponds to the largest value of $T_k$ is selected as the optimum vector to encode the residual waveform. The above computation of $E_{yy}$ has the advantage of incorporating the forward, and backward pitch sharpening into the codebook search in a low complexity method, thereby reducing the memory requirements to just M values for storing a single-dimensional $\phi(i)$ vector, unlike the existing requirement of a M×M values of a two dimensional matrix $\phi(i, j)$.

In an alternative configuration, a cross-correlation element 401 can be implemented that performs the function of generating the autocorrelation matrix $\phi$ and the cross-correlation value $E_{xy}$. In another embodiment, the energy value $E_{yy}$ can be generated using a pulse energy determination element 402 configured to generate a codebook and a composite representation of the codebook, and to compute the energy value using a received autocorrelation matrix. Alternatively, the pitch sharpener 470 could be implemented separately from the pulse code determination element 402. In yet another embodiment, a single processor and memory can be configured to perform all functions of the individual components of FIG. 4.

Figure 5:
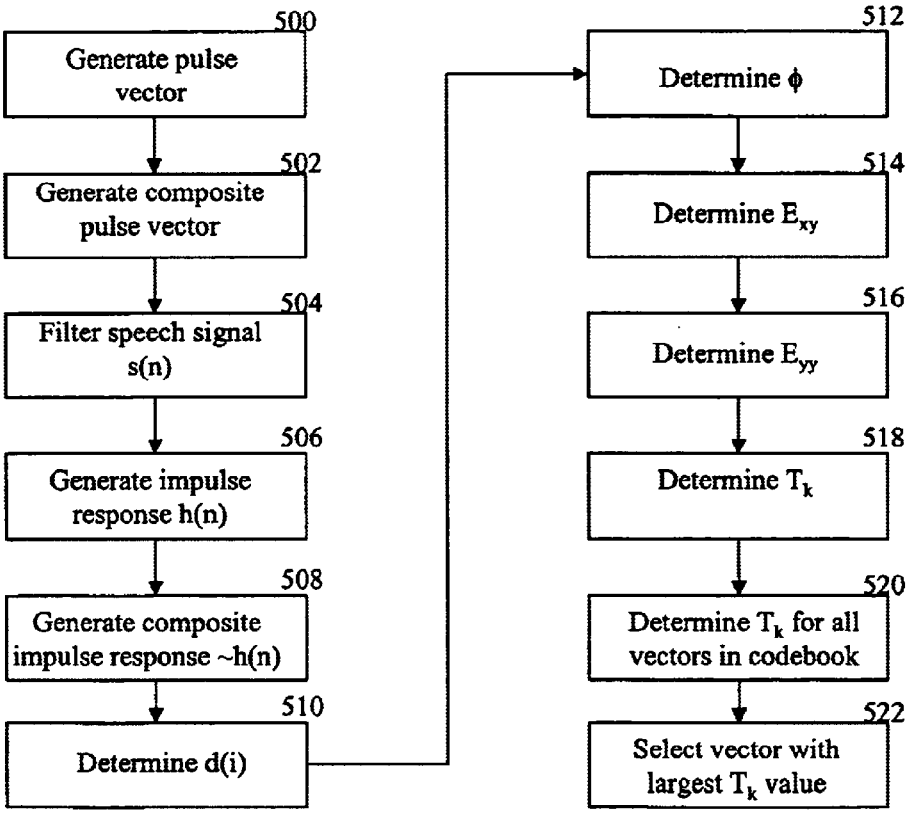
FIG. 5 is a flow chart of method steps for performing a fast codebook search.

FIG. 5 is a flow chart illustrating a method for performing a fast codebook search in a coder that uses pitch-enhanced impulse responses. A processor and memory can be configured to perform the method steps. At step 500, a primary pulse vector is generated. At step 502, a composite pulse vector is generated comprising primary pulses and secondary pulses. At step 504, a speech signal s(n) is filtered to produce a target signal x(n). At step 506, an impulse response h(n) is generated. At step 508, the impulse response h(n) is used to generate a pitch-enhanced composite impulse response $\tilde{h}(n)$. At step 510, a cross-correlation value d(i) is determined based on the composite impulse response $\tilde{h}(n)$ and the target signal x(n). At step 512, a single dimensional autocorrelation matrix $\phi$ is determined using the impulse response h(n). At step 514, a value $E_{xy}$ is determined using the cross-correlation value d(i) and the pulse vector. At step 516, an energy value $E_{xy}$ is determined using the autocorrelation matrix $\phi$, the composite pulse vector, and the primary pulse vector. At step 518, a maximal criterion $T_k$ is determined using $E_{xy}$ and $E_{yy}$. At step 520, the process is repeated for the next pulse vector of the codebook until all pulse vectors are exhausted. At step 522, the pulse vector with the largest maximal criterion $T_k$ is selected as the optimal excitation waveform to encode the speech signal within the analysis frame.

The method steps described above can be interchanged without affecting the scope of the embodiment described herein. For example, it is clearly possible to determine the value $E_{yy}$ before the value $E_{xy}$ without affecting the calculation for $T_k$.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for selecting an optimal pulse vector from a pulse vector codebook, wherein the optimal pulse vector is used by a linear prediction coder to encode a residual waveform, the apparatus comprising:

an impulse response generator for outputting an impulse response vector;

a correlation element configured to receive the impulse response vector and a plurality of target signal samples, to output an autocorrelation value based on the impulse response vector, and to output a cross-correlation vector based on a composite impulse response vector and the plurality of target signal samples, wherein the composite impulse response vector is determined using the impulse response vector; and a pulse energy determination element configured to generate an energy value using a pulse vector from the pulse vector codebook, a composite pulse vector that is determined using the pulse vector, and the autocorrelation value, wherein the energy value and the autocorrelation value are used by a metric calculator to determine a ratio value that is used to select the optimal pulse vector.

2. The apparatus of claim 1, wherein the apparatus is further configured to generate an energy value for each pulse vector of the pulse vector codebook, wherein the pulse vector that results with the largest ratio value is used to encode the residual waveform.

3. The apparatus of claim 1, wherein the pulse energy determination element comprises:

a pulse vector generator for generating the pulse vector codebook;

a pitch sharpener configured to receive the pulse vector and of generating the composite pulse vector; and an energy computation element configured to receive the pulse vector from the pulse vector generator, the composite pulse vector from the pitch sharpener, and the autocorrelation vector from the correlation element, and to determine the energy value.

4. The apparatus of claim 3, wherein the pitch sharpener determines the composite pulse vector in accordance with a predetermined pitch lag parameter and a predetermined pitch gain parameter.

5. The apparatus of claim 3, wherein the energy computation element determines the energy value in accordance with the formula:

$$E_{yy} = \sum_{i=0}^{N_p-1} \sum_{v=-k_1}^{k_2} g_p^{|v|} \tilde{\phi}(0) + 2 \cdot \sum_{i=0}^{N_p-1} \sum_{w=-v_1}^{v_2} \sum_{j=i+1}^{N_p-1} \sum_{v=-k_1}^{k_2} g_p^{|w|} g_p^{|v|} c_k(p_i^0) c_k(p_j^0) \phi(|p_i^w - p_j^v|)$$

wherein $E_{yy}$ is die energy value, $g_p$ is a pitch gain value, $p_x$ is the pulse position at the $x^{th}$ element in a pulse vector, and $\phi$ ( ) is the autocorrelation vector of the impulse response.

6. An apparatus for encoding a residual waveform, comprising:

a memory element; and a processor configured to implement an instruction set stored in the memory element, the instruction set for:

determining an autocorrelation value associated with an impulse response vector;

determining a cross-correlation value associated with a target signal and a pitch-sharpened impulse response vector, wherein the pitch-sharpened impulse response vector is determined from the impulse response vector;

determining an energy value for each pulse vector from a plurality of pulse vectors, wherein the energy value is determined using each pulse vector and a pitch-sharpened pulse vector associated with each pulse vector; and using the plurality of energy values and the cross-correlation value to determine a plurality of ratios, wherein the residual waveform is encode by using the pulse vector that provides a maximal ratio.

7. A method for selecting an optimal pulse vector from a codebook of pulse vectors, comprising:

determining an autocorrelation value associated with an impulse response vector;

determining a cross-correlation value associated with a target signal and a pitch-sharpened impulse response vector, wherein the pitch-sharpened impulse response vector is determined from the impulse response vector;

determining an energy value for each pulse vector from a plurality of pulse vectors, wherein the energy value is determined using each pulse vector and a pitch-sharpened pulse vector associated with each pulse vector; and using the plurality of energy values and the cross-correlation value to determine a plurality of ratios, wherein the residual waveform is encoded by using the pulse vector that is selected as having the highest ratio of the plurality of ratios.

8. An apparatus for selecting an optimal pulse vector from a codebook of pulse vectors, comprising:

means for determining an autocorrelation value associated with an impulse response vector;

means for determining a cross-correlation value associated with a target signal and a pitch-sharpened impulse response vector, wherein the pitch-sharpened impulse response vector is determined from the impulse response vector;

means for determining an energy value for each pulse vector from a plurality of pulse vectors, wherein the energy value is determined using each pulse vector and a pitch-sharpened pulse vector associated with each pulse vector;

means for using the plurality of energy values and the cross-correlation value to determine a plurality of ratios; and means for selecting the pulse vector with the highest ratio of the plurality of ratios.

* * * * *